US006151852A

United States Patent [19]

Linn et al.

[11] Patent Number: 6,151,852

[45] Date of Patent: Nov. 28, 2000

[54] PARTITION SYSTEM

[75] Inventors: Ronald W. Linn, Columbus; Harold W. Pool, Elizabethtown, both of Ind.

[73] Assignee: Spaceguard Incorporated, Seymour, Ind.

[21] Appl. No.: 09/310,366

[22] Filed: May 12, 1999

[51] Int. Cl.[7] ..... E04H 17/16

[52] U.S. Cl. ..... 52/239; 52/243; 52/282.4; 52/745.1; 256/24; 256/25

[58] Field of Search ..... 52/239, 243, 298, 52/282.4, 71, 745.05, 745.1, 799.1, 799.11; 256/24, 25, 54, 68

[56] References Cited

U.S. PATENT DOCUMENTS

| | | | |
|---|---|---|---|
| 1,164,160 | 12/1915 | Arey . | |
| 1,251,926 | 1/1918 | Schlesinger . | |
| 1,385,694 | 7/1921 | McCloud . | |
| 1,585,137 | 5/1926 | Weber . | |
| 2,361,620 | 10/1944 | Gerlach et al. . | |
| 2,867,857 | 1/1959 | McCarthy . | |
| 2,871,619 | 2/1959 | Walters . | |
| 2,927,665 | 3/1960 | Hauf . | |
| 2,999,568 | 9/1961 | Ludwig et al. . | |
| 3,080,022 | 3/1963 | Mote . | |
| 3,110,131 | 11/1963 | Jeffress . | |
| 3,180,457 | 4/1965 | Bohnsack . | |
| 3,215,118 | 11/1965 | Behlen . | |
| 3,355,848 | 12/1967 | Ulery . | |
| 3,508,364 | 4/1970 | Thompson . | |
| 3,755,982 | 9/1973 | Schmidt . | |
| 3,807,115 | 4/1974 | Baltz . | |
| 3,813,832 | 6/1974 | Caplan . | |
| 3,839,834 | 10/1974 | Goddard . | |
| 3,958,388 | 5/1976 | Hawes . | |
| 4,083,535 | 4/1978 | Britt | 256/24 |
| 4,526,347 | 7/1985 | McLoughlin . | |
| 4,754,584 | 7/1988 | Newton, II . | |
| 4,794,744 | 1/1989 | Young et al. | 256/24 X |
| 5,100,108 | 3/1992 | Schultz | 256/24 |
| 5,371,982 | 12/1994 | Douglas et al. . | |
| 5,379,564 | 1/1995 | Wynne . | |
| 5,402,988 | 4/1995 | Eisele | 256/24 |
| 5,421,557 | 6/1995 | Vise . | |
| 5,430,984 | 7/1995 | Young et al. | 256/24 X |
| 5,488,808 | 2/1996 | Cahill et al. . | |
| 5,556,080 | 9/1996 | Vise . | |
| 5,813,662 | 9/1998 | Langkruis | 256/25 |

*Primary Examiner*—Beth A. Stephan
*Assistant Examiner*—Brian E. Glessner
*Attorney, Agent, or Firm*—Woodard, Emhardt, Naughton, Moriarty & McNett

[57] ABSTRACT

A method and apparatus for providing a wire mesh security enclosure. In one embodiment the apparatus includes a plurality of unstacked, vertically oriented rectangular mesh panels coupled together to form a mesh wall. The mesh wall is anchored along a periphery defining the area to be protected. The mesh enclosure is reinforced by a plurality of independently positioned support posts offset from the interior of the mesh wall. The support posts are anchored to the floor interior of the mesh wall and are respectively coupled to the interior side of the mesh wall. The design of the security enclosure provides increased flexibility regarding the placement of the anchor posts and permits one-person assembly.

22 Claims, 9 Drawing Sheets

PARTITION SYSTEM

TECHNICAL FIELD OF THE INVENTION

The present invention relates generally to the field of security enclosures, and more specifically a modular mesh-walled security cage.

BACKGROUND OF THE INVENTION

In addition to providing safety areas for personnel, wire mesh enclosures are commonly used to provide additional security for the storage of valuable tools and equipment. Wire mesh enclosures are typically constructed from wire mesh panels placed together to form walls. Rigid reinforcement members are used to frame the wall panels and hold them together. The assembled wire mesh walls are typically secured to pre-existing walls and/or floors by flanged fittings and/or reinforcement posts. Wire mesh enclosures may also have wire mesh panel ceilings for three-dimensional protection.

One difficulty with the assembly of known wire mesh enclosures is the requirement of two or more workers to properly align the panels and attach the framing members. Often, the wire mesh panels are stacked horizontally, requiring at least two people to balance them while they are framed and secured to a reinforcement post. See, for example, U.S. Pat. No. 3,839,834 to Goddard. Stacking of long panels, one on top of the other, inherently requires the frequent periodic placement of anchor posts to provide sufficient rigidity to the enclosure walls. Conventionally, the posts are located between the ends of adjacent panels. The posts are positioned coplanar with the panels, defining a wall of an enclosure. Construction of such an enclosure requires the efforts of at least two workmen. Construction of the enclosure is further complicated if the enclosure has to be moved or adjusted to accommodate obstacles or irregularities in the floor interfering with the placement of anchor posts at regular intervals. Further, the requirement of a great number of individual wire mesh panels and solid framing pieces and fasteners to be combined together weakens the security of the enclosure. The chances of a breach in the security enclosure increase with the number of parts used. Moreover, such systems are inherently expensive to produce and assemble, since they require many different parts to be fabricated, shipped and stored as well as substantial workman time to construct.

There is a need for an inexpensive mesh security enclosure offering greater security, having fewer connectable parts to produce, ship, and store, having increased flexibility regarding the placement of the anchor posts, and requiring only one person to assemble in a short time. The present invention satisfies this need.

SUMMARY OF THE INVENTION

In one aspect, the present invention relates to a method and apparatus for the rapid construction of a wire mesh security enclosure by a single worker. In this form, the present invention contemplates a wire mesh security enclosure constructed of vertically oriented rigidly framed wire mesh panels secured to each other to form a wire mesh wall. The wire mesh wall is mounted in place by plurality of base shoes fastened to the floor and coupled to the wire mesh wall. The base shoes support the wire mesh wall above the floor. Rigid support rods are also anchored to the floor inside the enclosure and coupled to the wire mesh wall to provide additional support as necessary.

One object of the present invention is to provide an improved mesh-walled security partition system. Related objects and advantages of the present invention will be apparent from the following description.

DETAILED DESCRIPTION OF THE PREFERRED EMBODIMENT

Figure 1A:
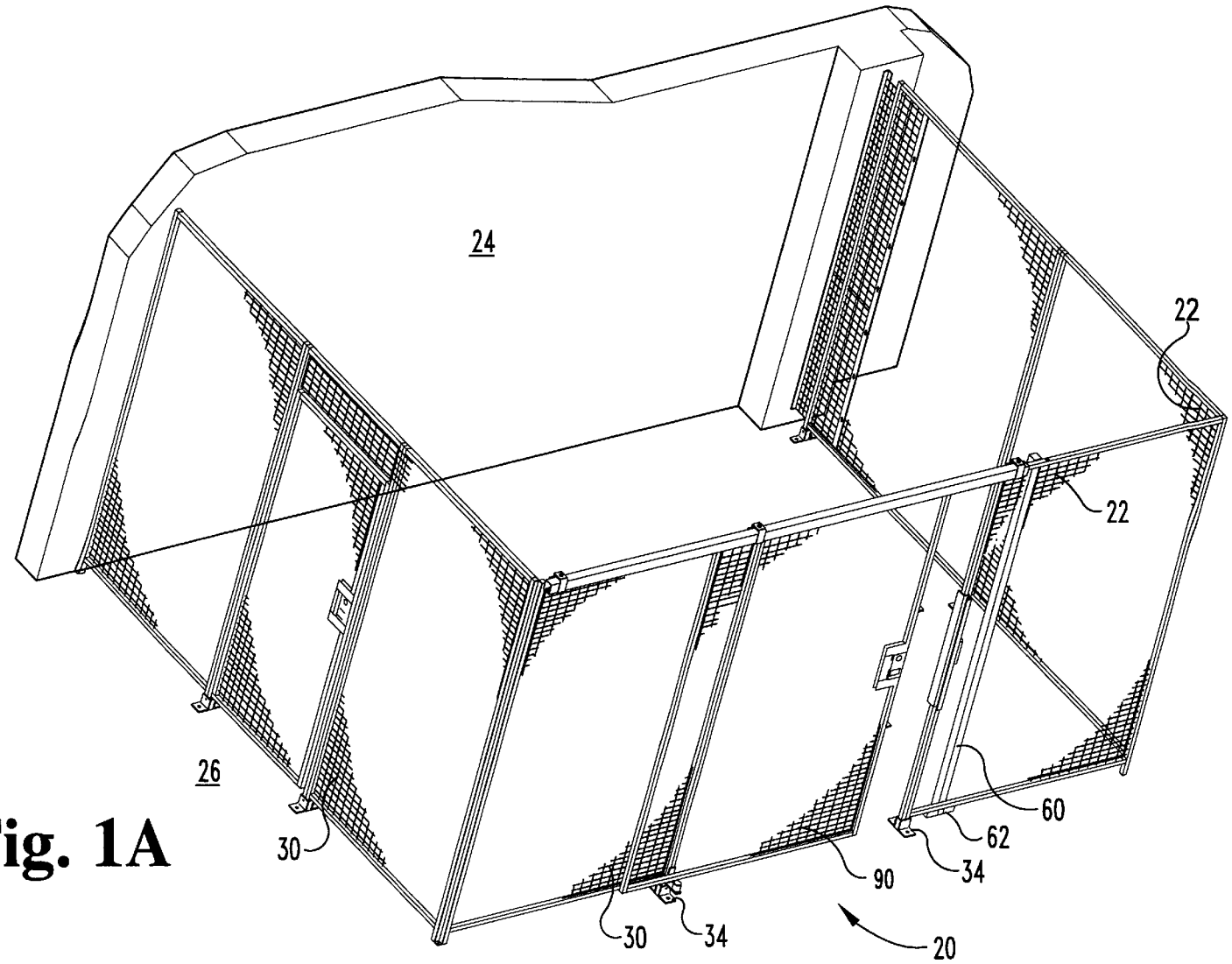
FIG. 1*a* is perspective view of a first embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 1B:
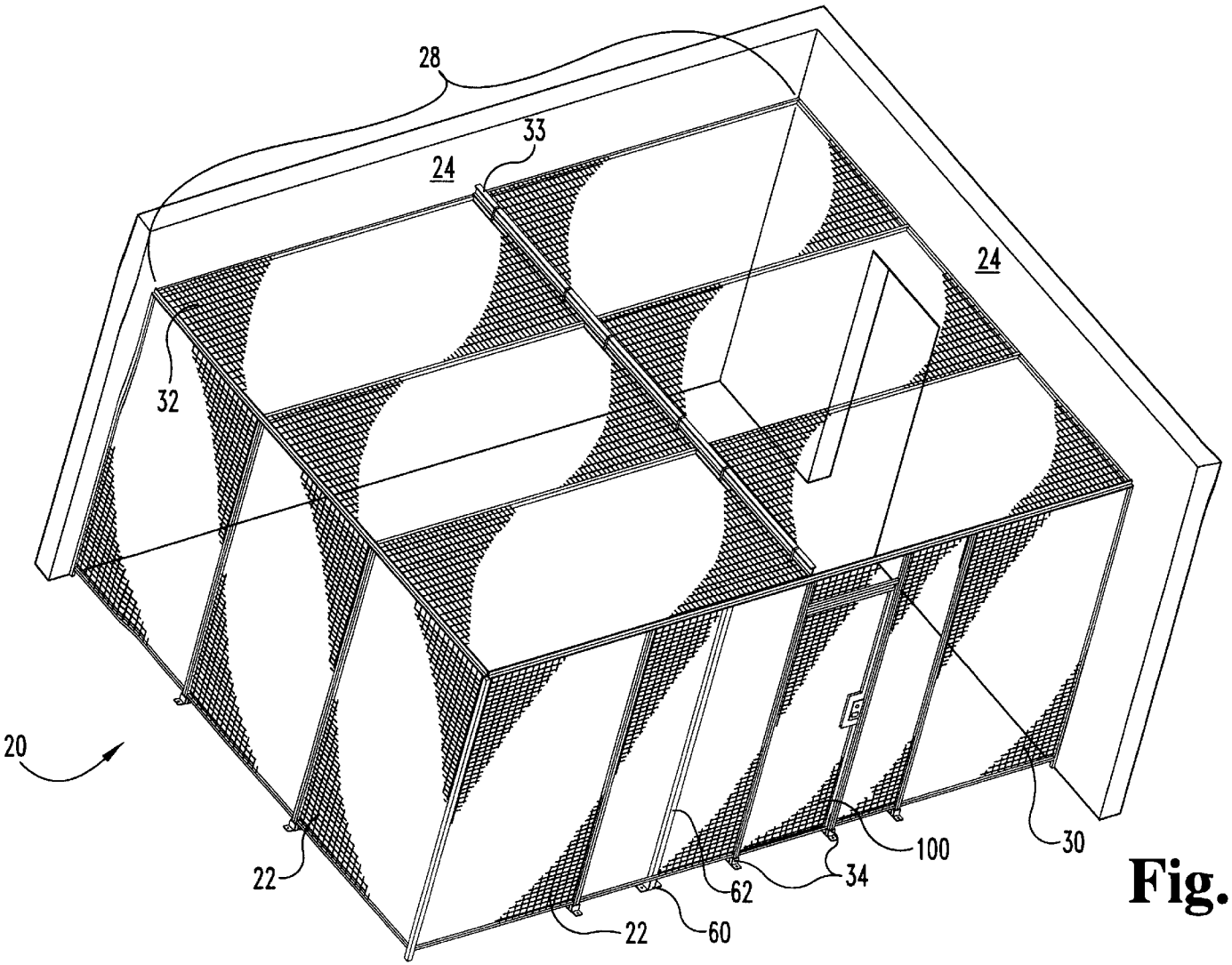
FIG. 1*b* is a perspective view of a second embodiment of the present invention.

FIG. 1*a* illustrates the preferred embodiment of a wire mesh enclosure system 20 according to the present invention. The mesh enclosure system 20 comprises a mesh wall 22 which may either be attached to an existing structural wall 24 or freestanding (i.e. coupled only to the floor 26 and not to any other structural member such as a wall 24). The mesh enclosure 20 is suspended a few inches above floor 26 and may be covered by a mesh ceiling 28 (see FIG. 1*b*). The mesh wall 22 is comprised of a plurality of unstacked framed rectangular mesh panel members 30. The optional mesh ceiling 28 is comprised of a plurality of framed mesh ceiling panel members 32 and may include one or more ceiling support members 33. The mesh wall 22 is supported above the floor by a plurality of base shoes 34.

Figure 2:
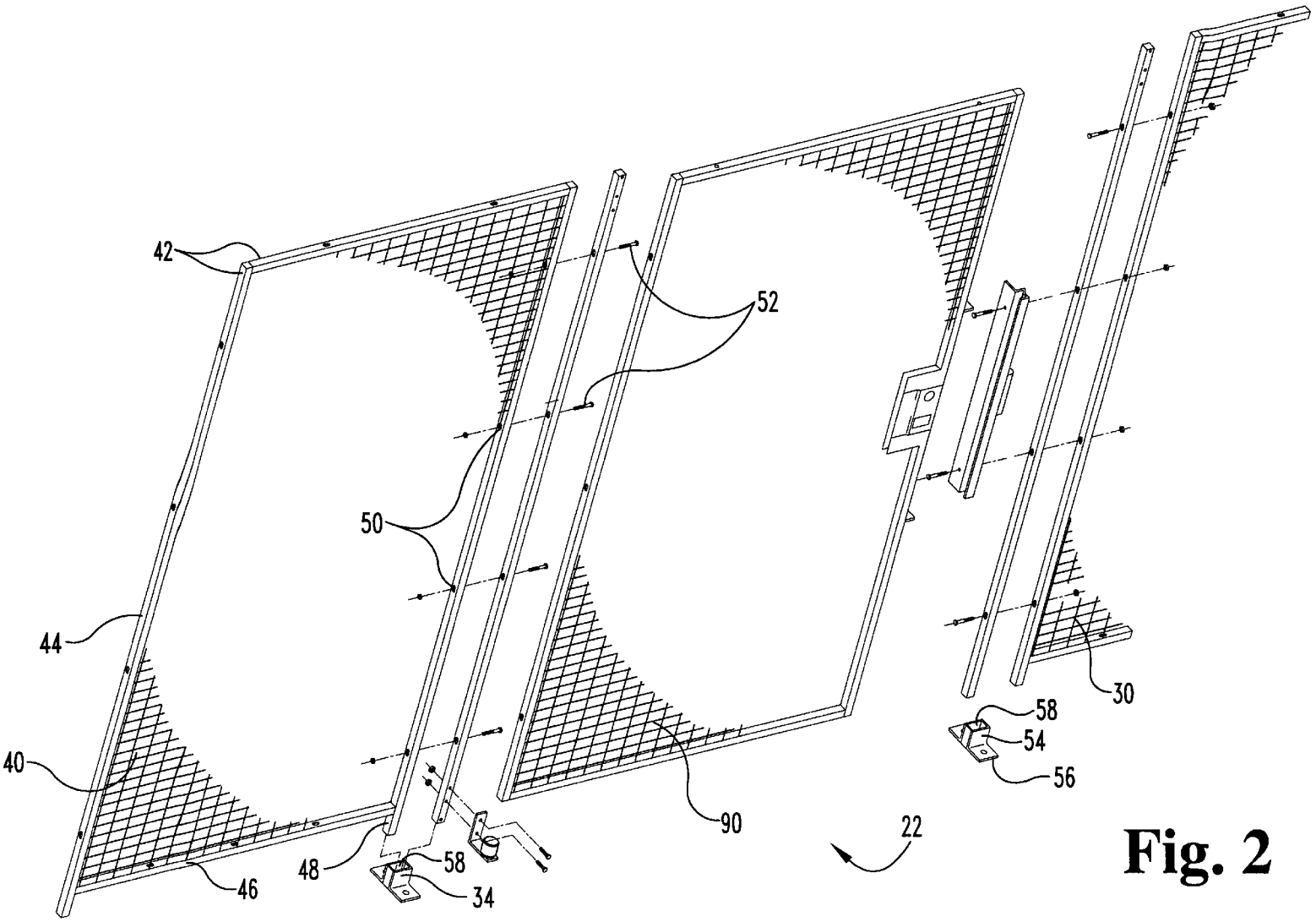
FIG. 2 is an exploded perspective view of a section of the mesh wall of the embodiment of FIG. 1*a*.

FIG. 2 illustrates the mesh wall 22 in exploded detail. The mesh wall 22 is made up of a plurality of adjacently connected rectangular mesh panel members 30. The rectangular panel members 30 are preferably selected from a set of predetermined standard sizes. The rectangular panel members 30 are provided in several standard sizes approximately eight feet high and in widths of one, two, three, four, or five feet. Other forms of the present invention are contemplated having rectangular panel members of other standard sizes as might be required to meet the security needs of a given situation.

The framed rectangular wire mesh panel members 30 each include a rectangular wire mesh panel member 40 framed by framing members 42. The wire mesh panel member 40 is made of heavy gauge wire strands to enhance its rigidity. It is preferred that the wire strands be at least 8 gauge thick. It is also preferred that the wire strands be oriented parallel to the framing members 42, crisscrossing horizontally and vertically, and welded at the respective intersection points of the wire strands. The rectangular mesh panels 30 are framed at the sides by long vertical framing members 44 and at the top and bottom by short horizontal framing members 46. In each framed mesh panel 30, the long vertical framing members 44 extend about three inches past the bottom horizontal framing member 42. The portion of a vertical framing member 44 extending past the bottom vertical framing member 42 is defined to be the shoe-connecting portion 48.

Framing members 42 are preferentially formed from tubular steel of a thickness of about 16-gauge or thicker. Framing members 42 are more preferentially formed from 16-gauge tubular steel having a one-inch square cross-section.

Framing members 42 also contain regularly spaced apertures 50. Apertures 50 are adapted to allow the passage of the shaft portions of fasteners 52 but not the head portions thereof. Apertures 50 are also regularly spaced such that any two panels may be adjacently positioned in a vertical orientation with apertures 50 aligned.

Figure 4:
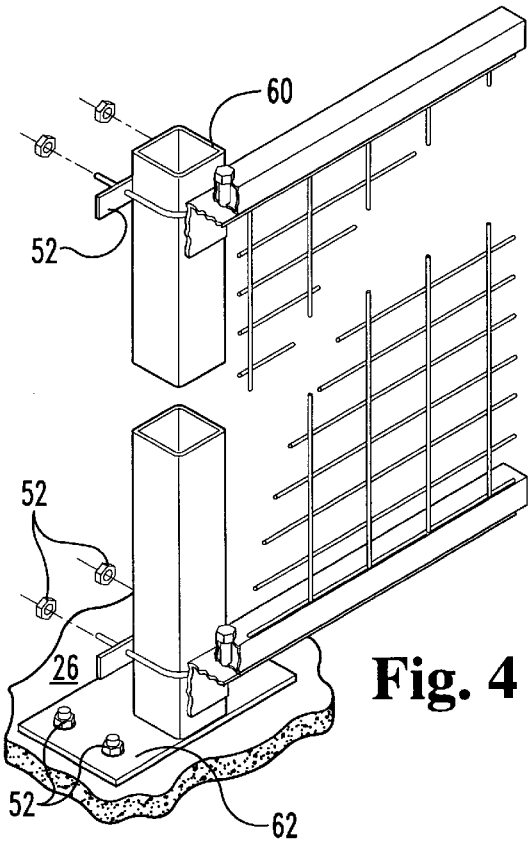
FIG. 4 is an enlarged perspective view of a support post attached to the mesh wall of FIG. 1*a*.

FIG. 4 illustrates the relationship between mesh panel members 30 and base anchor shoes 34. Base shoes 34 each include a socket portion 54 and a flange portion 56. Socket portion 54 is adapted to receive one or more shoe-connecting portions 48. Preferentially, socket portion 54 is adapted to snugly receive two adjacent shoe-connecting portions 48. More preferentially, socket portion 54 defines a rectangular well having a two-inch by one-inch rectangular cross section and a depth of about an inch.

Flange portion 56 extends perpendicular to the direction of socket portion 54 and is adapted to be fastened to floor 26. Flange portion 56 includes at least one aperture 58 adapted to receive a fastener 52, such as a bolt. Preferentially, flange portion 56 includes a plurality of apertures 58. Alternately, flange portion 56 may include no apertures and be fastened to floor 26 with cement or an adhesive.

Base shoe 34 may also include apertures 58 in socket portion 54. Fasteners 52 may be used to connect the shoe-connecting portion of vertical framing member 44 to base shoe 34. Alternatively, base shoe 34 may contain a spring lock or the like (not shown) adapted to engage shoe-connecting portion 48 upon contact.

Figure 5B:
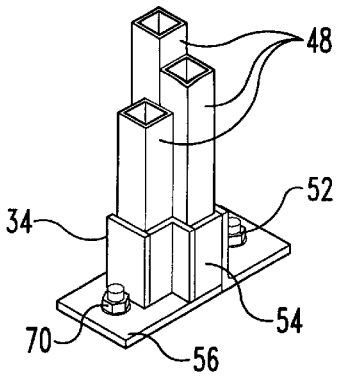
FIG. 5*b* is a partial perspective view of a corner shoe of the present invention.
Figure 3:
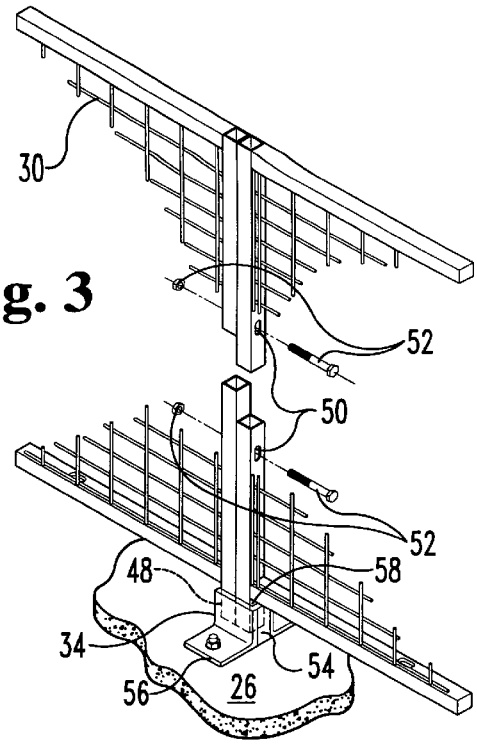
FIG. 3 is a partial perspective view of a portion of the mesh wall of FIG. 1*a*.
Figure 5A:
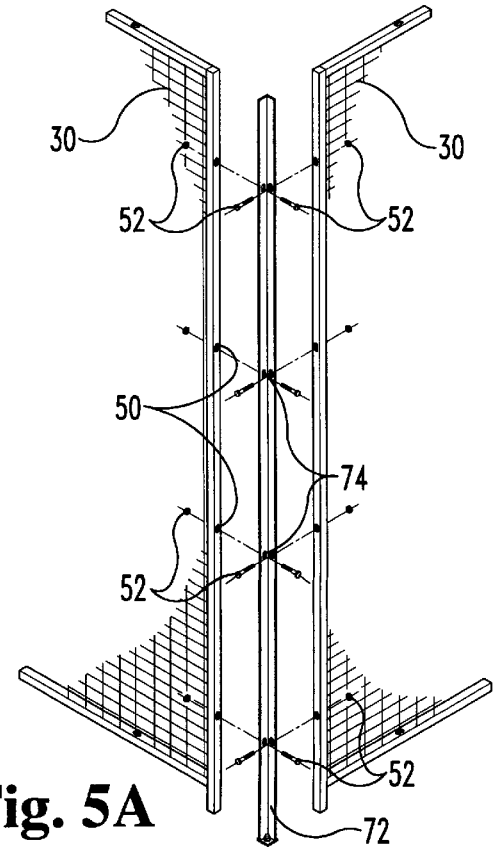
FIG. 5*a* is an exploded perspective view of the corner of the enclosure of FIG. 1*a*.

Mesh wall 22 is given additional support by one or more anchor posts 60 coupled to the interior of mesh wall 20, as illustrated generally in FIG. 1*a* and in detail in FIG. 5A. Anchor posts 60 are positioned offset from and immediately adjacent to the interior surface of mesh wall 22. The offset of the anchor posts 60 provides increased security by making the posts 60 more difficult to reach and tamper with from the outside of the mesh wall 22 while simultaneously offering increased flexibility regarding the placement of the posts 60, since post 60 placement is not determined by the intersection of mesh panel members 30.

Preferentially, anchor posts 60 rest in respective anchor shoes 62 affixed to the floor 26. More preferentially, anchor posts 60 are affixed to respective anchor shoes 62. Alternately, anchor posts 60 may be formed having integral anchor shoes (not shown). Anchor posts 60 are coupled to mesh wall 22 with fasteners 52. Anchor shoes 62 and posts 60 may be spaced at regular intervals or irregularly positioned as necessary, depending on the design and functional specifications of enclosure 20 (FIG. 1*a*). In contrast to prior art security enclosures having designs that restrict the positioning of the anchor posts to the spaces between adjacent panel members, the present invention allows the offset anchor posts 60 to be positioned at any desired spacing intervals, independent of the horizontal dimensions, i.e. width, of the panel members 30.The framed wire mesh panel members 30 gain sufficient rigidity from the heavy gauge wire and steel frame members 42 such that the plurality of anchor shoes 62 and posts 60 may be placed at intervals substantially exceeding the widths of the wire mesh panels 30, up to about 20 feet apart.

Figure 5C:
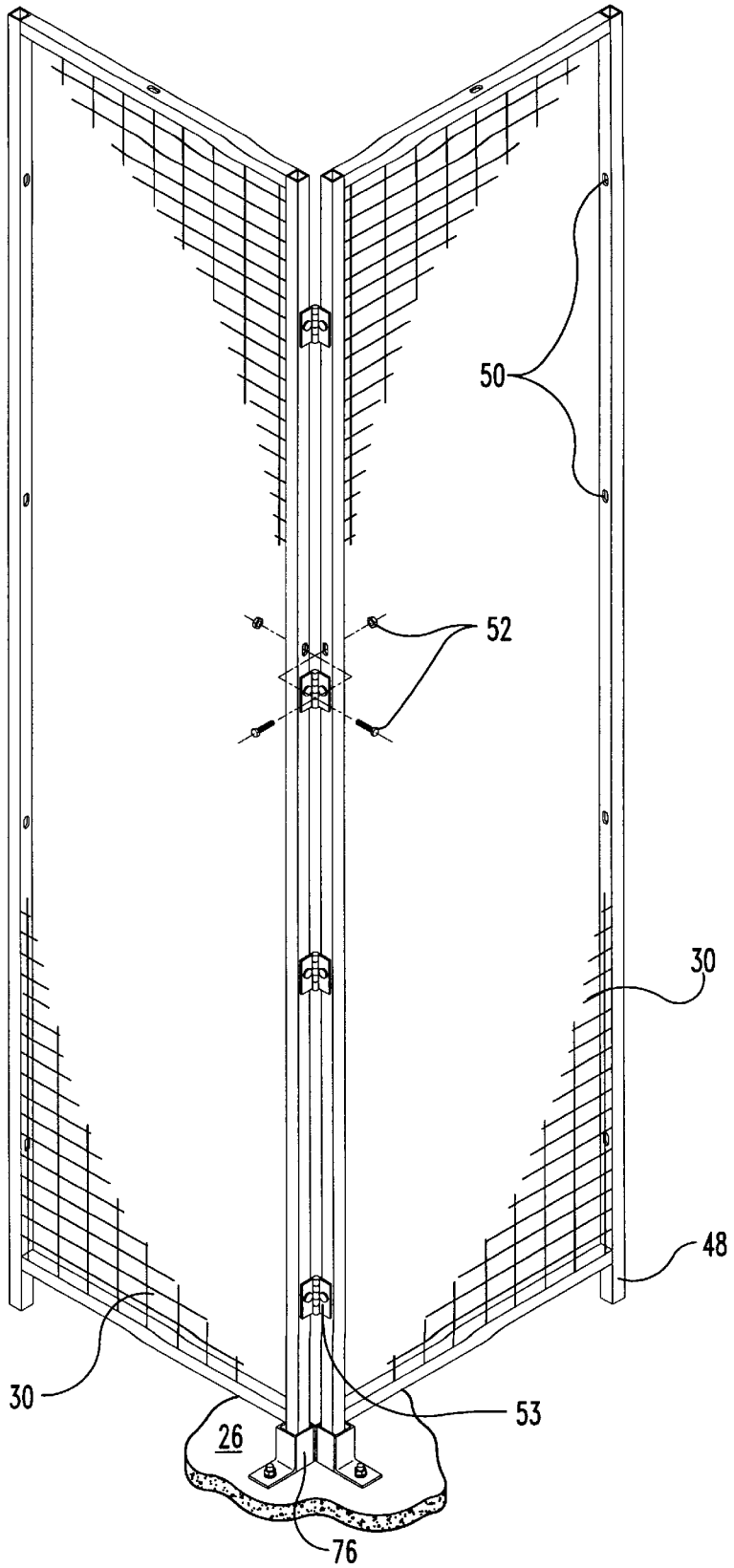
FIG. 5*c* is a perspective view of an alternate form of a corner of the enclosure of the present invention.

FIGS. 5*a*, 5*b*, and 5*c* illustrate a first and a second corner formed by the intersection of two panel members 30. FIGS. 5*a* and 5*b* illustrate a first form of a corner wherein corner shoe 70 is positioned to support the mesh wall 22 (FIG. 1*a*) at a right corner. Corner shoe 70 is adapted to receive the shoe-connecting portions 48 of two intersecting panel members 30. Since apertures 50 of standard panel members 30 do not align at corner intersections, corner post member 72 is provided to couple intersecting panel members 30. Corner post member 72 is formed with right-angular inner surface having apertures 74 adapted to align with the apertures 50 of both intersecting panel members 30. Fasteners 52 are uses to couple the corner post member to both intersecting panel members 30. Corner shoe 70 is adapted to snugly receive corner post member 72 along with the shoe connecting portions 48 of the joined intersecting panel members 30.

Alternately, FIG. 5*c* illustrates another form of a corner wherein hinged corner fasteners 53 may be used to join intersecting panel members 30. Hinged corner fasteners 53 are adapted to attach to apertures 50 and allow some flexibility in the corner intersection angle. The shoe-connecting portions 48 of each panel 30 are coupled to single-panel shoes 76. Single-panel shoes 76 are fastened to floor 26 by fasteners 52 or the like.

Figure 6A:
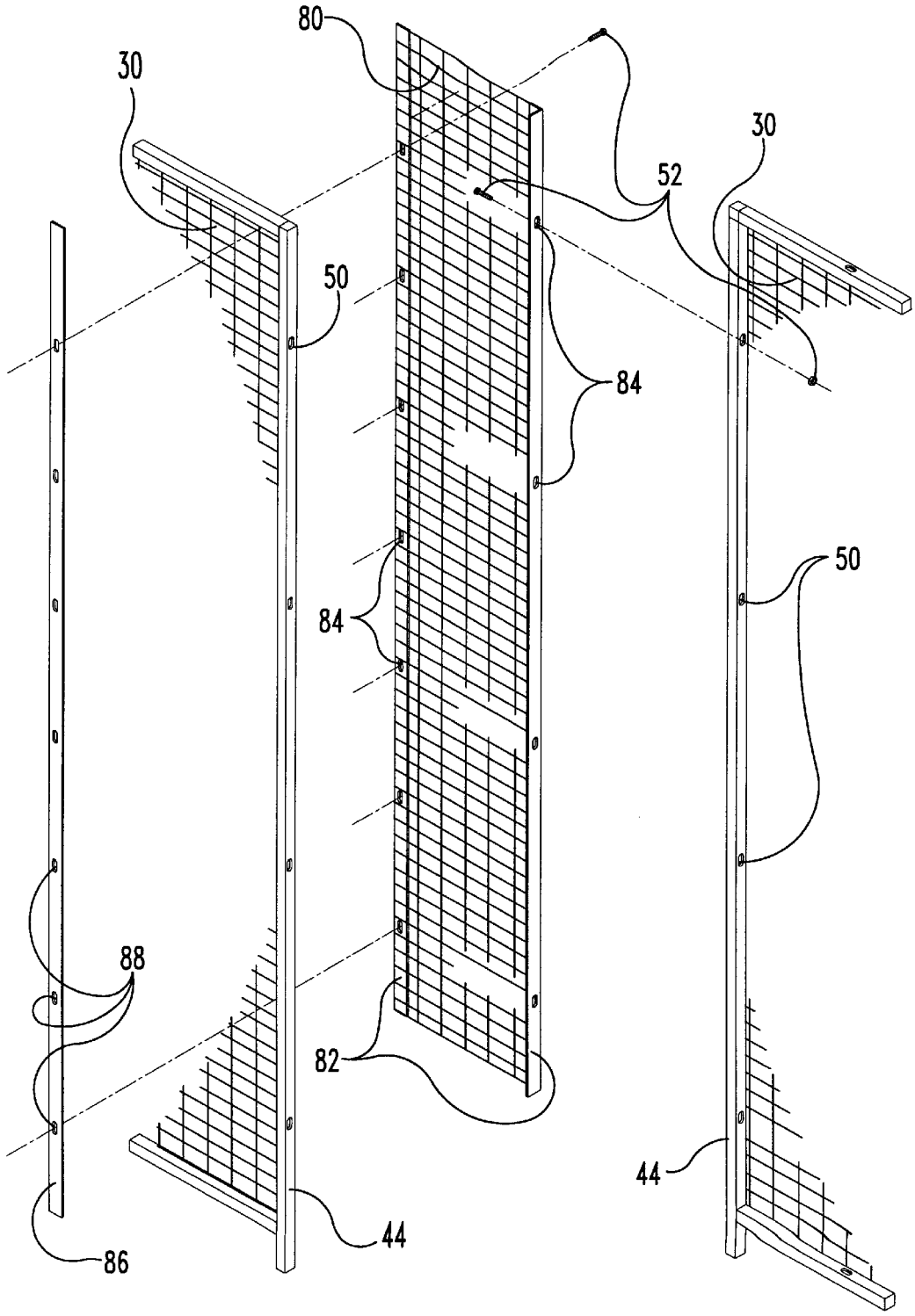
FIG. 6*a* is an exploded perspective view of a mesh wall having an adjustable panel member according to the present invention.
Figure 6B:
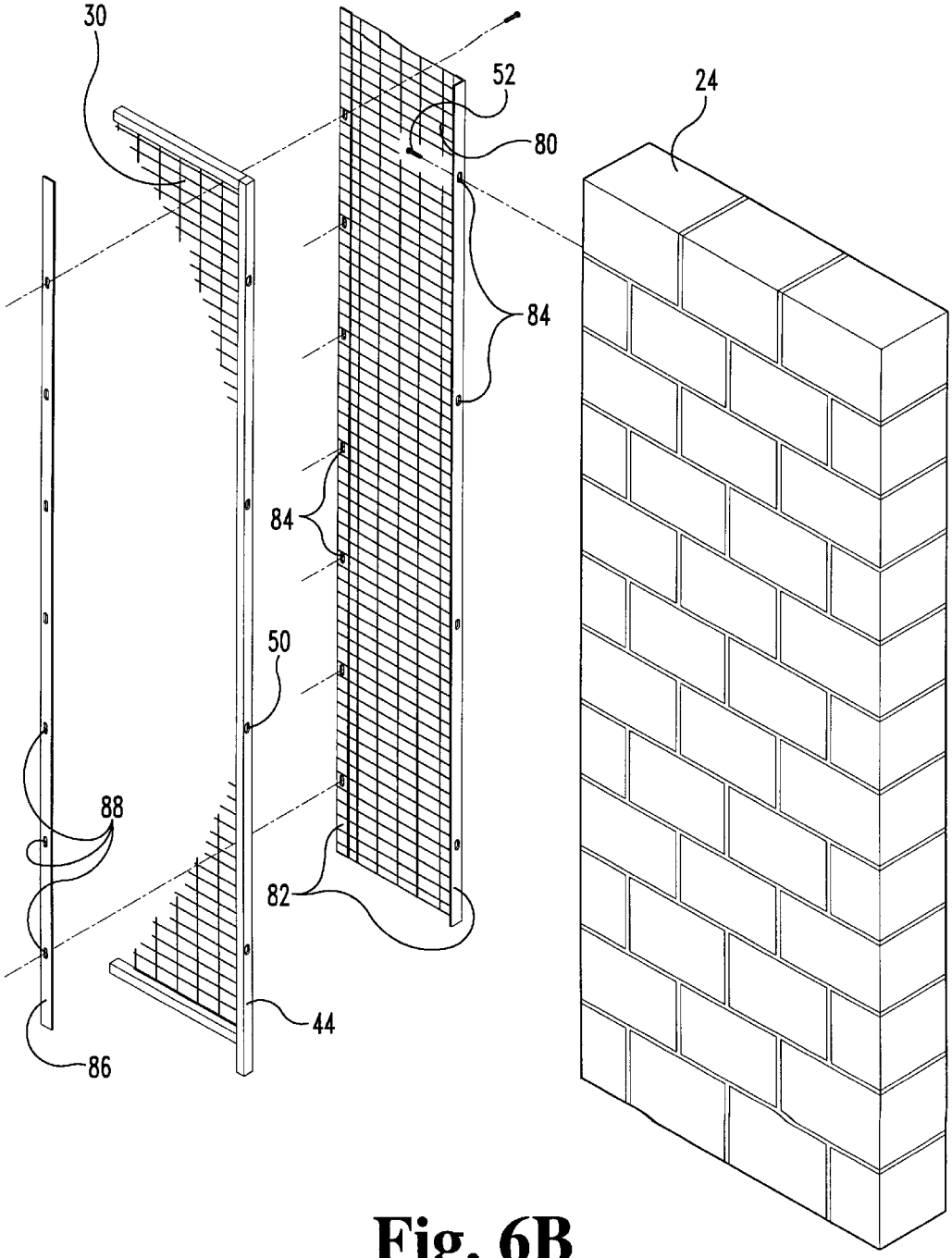
FIG. 6*b* is an exploded perspective view of the adjustable panel member of FIG. 1*a*.

FIGS. 6*a* and 6*b* illustrates adjustable panel member 80. Adjustable panel member 80 is used to eliminate the need for precision measurement of the enclosure dimensions and provide a margin of error for the construction thereof. Adjustable panel member 80 has the same vertical dimension or height as all of the other wall panels 30 while having a shorter horizontal dimension or width. Adjustable panel member 80 is not framed, but is instead a relatively narrow welded wire mesh rectangular panel having a thin solid portion 82 running the length of each vertical or long side. The solid portion 82 is provided with apertures 84 aligned with apertures 50 provided in the vertical framing members 44. A narrow solid strip 86 having apertures 88 is aligned with apertures 84 of thin solid portion 82. In operation one end of the adjustable panel may be connected to a free end of a mesh panel 30 by overlapping a narrow solid portion 82 adjacent the mesh panel 30 and positioning a narrow solid strip 86 on the opposite side of the mesh panel 30 such that the apertures 84, 88 align. The adjustable panel 80 is then secured in place with fasteners 52 extending through the respective apertures 84, 88. The other end of adjustable panel 80 may be likewise secured to another mesh panel 30 (see FIG. 6*a*) or to a structural wall 24 (see FIG. 6*b*) using fasteners 52 adapted to be embedded in wood, metal, concrete, or the like. Narrow solid strip 86 is not required when securing adjustable panel 80 to a structural wall 24.

In one form of adjustable panel 80, solid portions 82 are both oriented parallel to panel member 80. In another form, one solid portion 82 is oriented parallel to panel member 80 while another other solid portion 82 is oriented perpendicular to panel member 80. In yet another embodiment, both solid members 82 are oriented perpendicular to panel member 80. Preferentially, adjustable mesh panel member 80 is formed from wire of thick enough gauge to provide support to the mesh wall 22 (FIGS. 1*a* and 1*b*) but thin enough to remain sufficiently deformable to allow solid portion 82 to be bent into a desired orientation by a workman.

Figure 7:
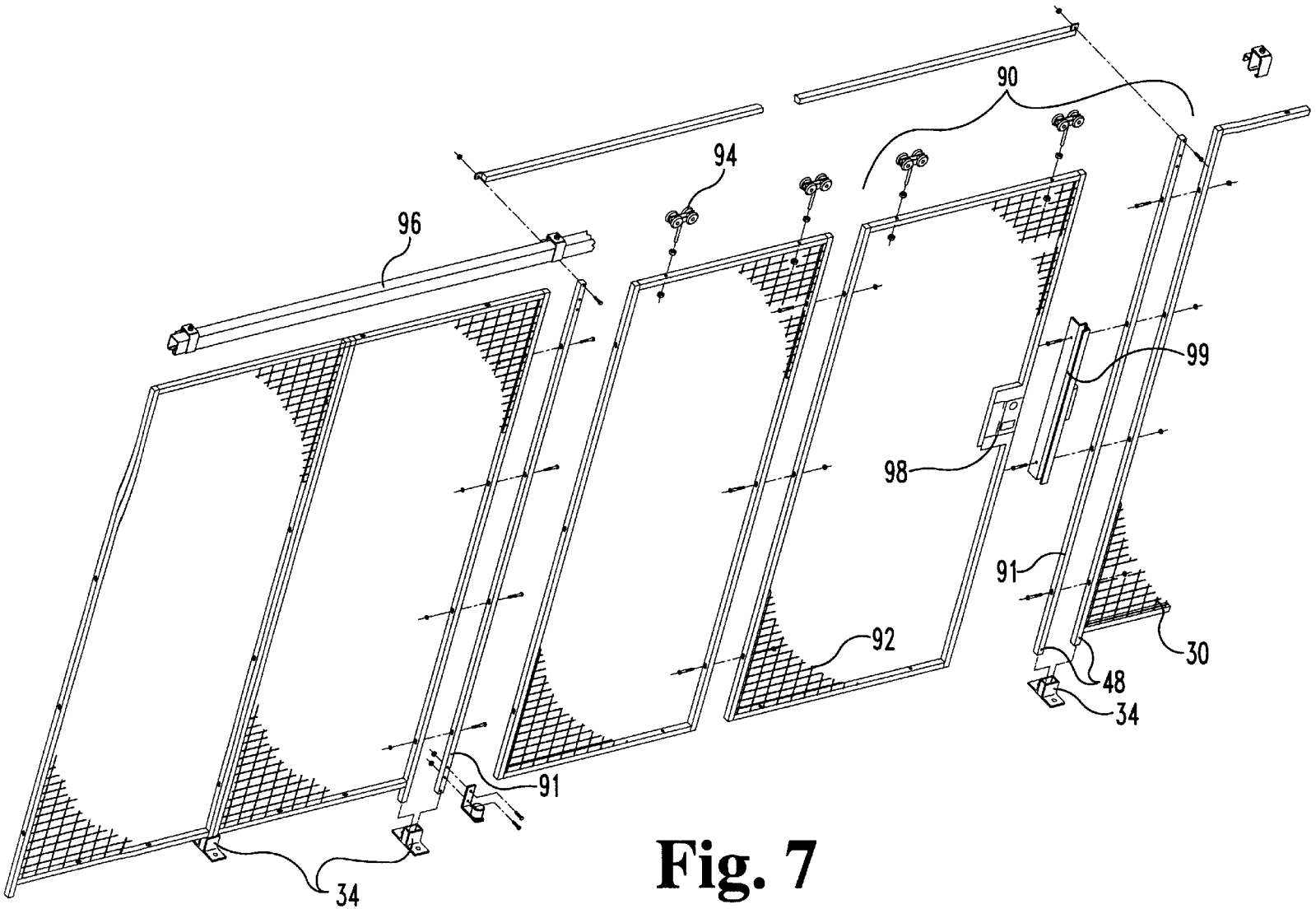
FIG. 7 is an exploded perspective view of the sliding door of FIG. 1*a*.
Figure 8:
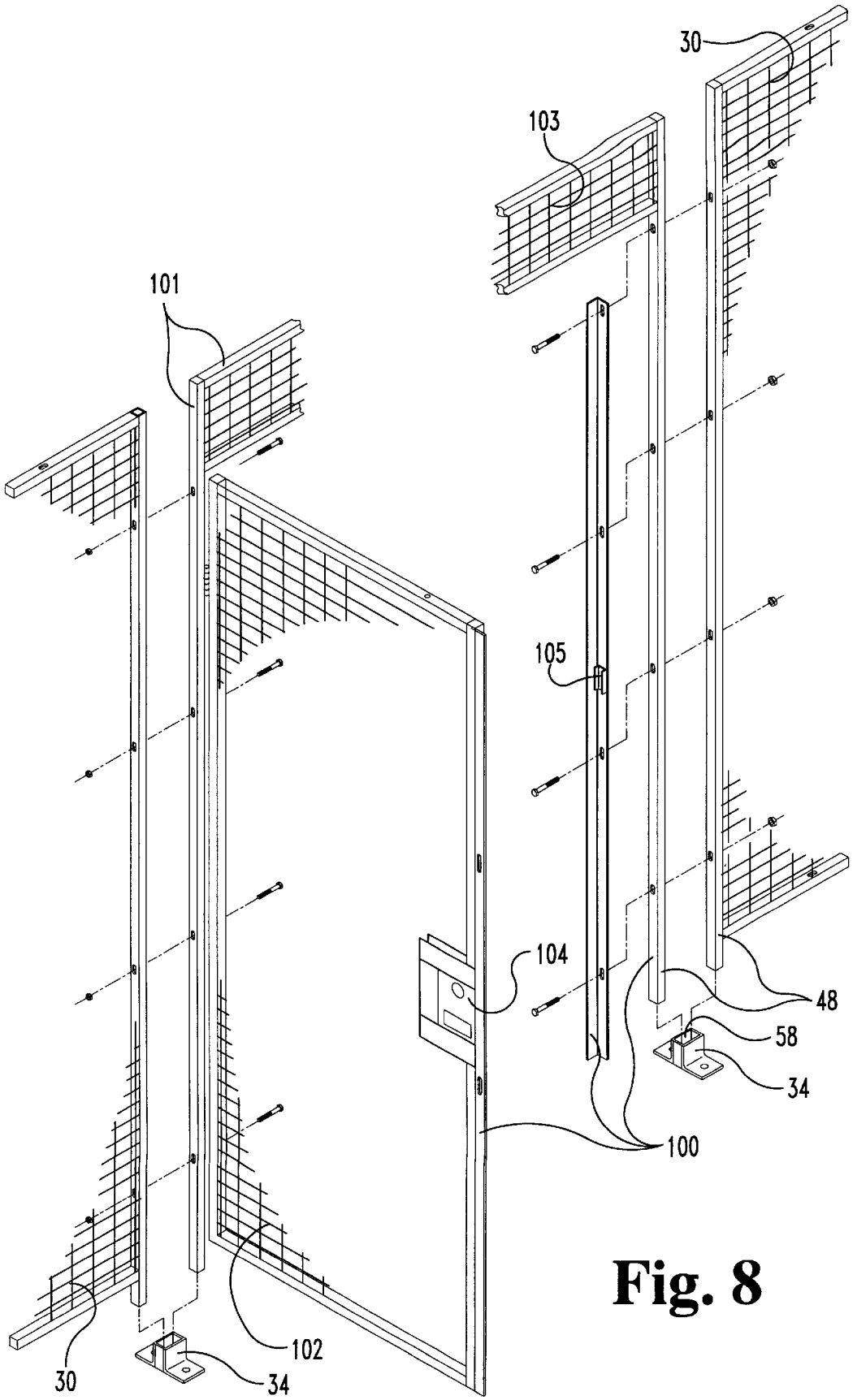
FIG. 8 is an exploded perspective view of the pre-hung door of FIG. 1*b*.

FIGS. 7 and 8 illustrate specialized mesh panels 30. FIG. 7 illustrates a pre-hung sliding door panel 90 having a frame portion 91 and a sliding mesh door portion 92 adapted to slide on rollers 94 along a track portion 96. Frame portion 91 defines an area occupied by door portion 92 when door portion 92 is in a closed position. The dimensions of frame portion 91 are identical to the dimensions of at least some of regular panel members 30, allowing pre-hung door panel 90 to be interchangeable therewith. Frame portion 91 further includes shoe-connecting portions 48 identical to of other panel members 30. Track portion 96 extends along the top of frame portion 91 and is adapted to partially overlap an adjacent panel member 30. Door portion 92 is adapted to slideably engage track portion 96 and move back and forth between a closed position and an open position, sliding parallel and adjacent to mesh wall 22 (FIG. 1*a*).

In one form, the track portion 96 is mounted above the door portion 92, such that the door portion 92 is suspended from the track portion 96. The rollers 94 are coupled to the top of the door portion 92 and are movably contained in the track portion 96. In another form, the track portion 96 is mounted beneath the door portion 92, with rollers 94 coupled to the bottom of the door portion 92 and adapted to be rollably contained in the track portion 96.

Door portion 92 also includes a first lock mechanism 98 adapted to lockably engage a second lock mechanism 99 coupled to the frame 91. The first and second locking mechanisms 98, 99 may be built in, such as a sliding bolt lock or a turning latch lock, or they may be attachable, such as a pad lock through a pair of aligned apertures.

FIG. 8 illustrates a first form of a pre-hung swinging door panel 100 having a frame portion 101, a door portion 102, and a transom portion 103. The frame portion 101 defines the area occupied by the door portion 102 when the door portion 102 is in the closed position. The dimensions of frame portion 101 are identical to the dimensions of at least some of the standard panel members 30, allowing pre-hung door 100 to be interchangeable therewith. Frame portion 101 further includes shoe-connecting portions 48 identical to those of other panel members 30. Transom portion 103 is a rectangular wire mesh member extending downward from the top of frame 101 and extending horizontally from one side of frame 101 to the other. Door portion 102 is mounted below transom portion 103 and is hingedly coupled to one side of frame portion 101. Door portion 102 is adapted to pivot outwardly of enclosure 20 (FIG. 1*b*) from a closed position parallel to transom 103 to an open position. Swinging door panel 100 also includes a first locking mechanism 104 adapted to lockingly engage a second locking mechanism 105. First locking mechanism 104 is connected to door portion 102, while second locking mechanism 105 is connected to frame portion 101. First locking mechanism 104 is adapted to engage second locking mechanism 105 when door portion 102 is pivoted into a closed position.

In another form, door portion 102 is adapted to swing inwardly of the enclosure 20 (not shown). In still another form, swinging door panel 100 does not include transom portion 103, but instead includes door portion 102 adapted to substantially fill the area defined by frame portion 101 (not shown). Other contemplated specialized panel members include a mesh panel member having a service window positioned therein (not shown).

The wire mesh panels, framing members, shoes, and post members are preferentially formed from structural steel, although they may be formed from any structural material having sufficient rigidity and strength.

In operation, an enclosure 20 may be laid out and assembled by a single worker. First, the area to be enclosed is defined by a perimeter or periphery along which the wire mesh wall 22 will be deployed. Next, base shoes 34 are set out at intervals equal to the horizontal dimension of the panels 30. It is noted that there may be a variety of acceptable horizontal dimensions of the regular panel members 30, providing design versatility. At this point, the base shoes 34 may be fastened to the floor 26, although it is advisable to postpone this step until the wall 22 is completely assembled. A first framed mesh panel member 30 is positioned with the shoe-connecting portions 48 thereof aligned with two adjacent base shoes 34 comprising part of the security periphery or perimeter. The panel member 30 is then raised sufficiently for the shoe-connecting members 48 to become inserted into the respective base shoes 34. The panel 30 is then pivoted or rotated about the shoes 34 until it is in a vertical orientation. It is advisable that if the enclosure 20 is to include part of a structural wall 24, the first panel 30 erected be erected adjacent the wall 24. The erected panel 30 may then be connected to the wall by inserting suitable fasteners 52 through the apertures 50 in the vertical framing member 44 and into the wall 24, thus securing the panel 30 to the wall 24.

After a first panel 30 has been erected, a second panel 30 is erected in the same way. It is preferred that the second panel 30 be erected adjacent the first erected panel 30 with the apertures 50 in the framing members 42 aligned; the two adjacent panels 30 are then joined by the passage of fasteners 52 through the aligned apertures 50. The process is repeated until the enclosure 20 completely constructed along the periphery defined by the base shoes 34.

When the perimeter turns, a corner shoe 70 is used in place of a regular anchor shoe. The corner shoe may support a corner post 72. Further, as dictated by the enclosure design requirements, specialized panel members such as door panels 90, 100 may be used in place of one or more regular panel members 30. Still further, as dictated by the enclosure size and shape requirements, one or more adjustable panel members 80 may be used in place of a regular panel member 30.

At least one anchor shoe 62 may then be fastened to floor 26 inside the enclosure 20. A vertical support post 60 is then inserted into anchor shoe 62 and fastened into place. Support post 60 is also secured to mesh wall 22 to provide additional support. Anchor shoes 62 may be positioned regularly, or only as needed depending on the size, shape, complexity, and security requirements of the enclosure 20. Anchor shoes 62 and posts 60 may be spaced at intervals at least as far apart as about 20'. Finally, if it has not already been done, base shoes 34 should now be fastened to floor 26.

After mesh wall 22 has been completed, optional ceiling members 32 may be installed. Ceiling members 32 are similar to panel members 30 but without shoe-connecting portions 48. Installation of ceiling members 32 is accomplished by aligning the edges of ceiling members 32 with the upper perimeter of enclosure 20 formed by the top edge of mesh wall 22 and fastening ceiling members 32 to mesh wall 22 and each other. Ceiling members 32 are positioned adjacent one another, with apertures 50 aligned to receive fasteners 52. In enclosures 20 incorporating a structural wall 24, ceiling members 20 positioned adjacent structural wall 24 are fastened directly thereto. Mesh ceilings 28 covering larger enclosures 20 may also require one or more reinforcing support members 33 connecting adjacent ceiling panels 32 and anchored to mesh wall 22 and/or structural wall 24.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A wire mesh security enclosure system, comprising in combination:

a plurality of base shoes fastened to a floor and defining a periphery;

a plurality of unstacked rectangular framed wire mesh panels positioned substantially continuously around the periphery, each panel resting in two respective base shoes, wherein the panels intersect to define a mesh wall;

a plurality of post anchor shoes positioned offset from the interior of the mesh wall and fastened to the floor; and a plurality of posts wherein each post is affixed to a respective anchor shoe;

wherein the posts extend substantially vertically adjacent the mesh wall and are coupled to the mesh wall; and wherein the post anchor shoes are positioned independent of the intersections of the panels.

2. The wire mesh enclosure system of claim 1 wherein a plurality of the post anchor shoes are spaced apart at intervals substantially exceeding the width of the wire mesh panels and up to about twenty feet apart.

3. The enclosure system of claim 1 further comprising a plurality of anchor shoes anchored to the floor surface on a line forming an outline parallel and interior to the periphery, the distance between two anchor shoes being substantially greater than the width of the panels.

4. The wire mesh enclosure of claim 2 wherein the panels have a plurality of predetermined standard widths up to about five feet.

5. The wire mesh enclosure of claim 4 wherein the panels have a standard height of about eight feet.

6. The wire mesh enclosure of claim 5 wherein the wire mesh panels include wire strands that are about eight gauge thick.

7. The wire mesh enclosure of claim 6 wherein the wire strands crisscross horizontally and vertically and are welded together at their respective intersection points.

8. The wire mesh enclosure system of claim 1 wherein each of said plurality of rectangular framed wire mesh panels further comprises:

a substantially rectangular welded wire panel having a top, a bottom, and two opposing sides;

at least two heavy-gauge tubular steel horizontal frame members adapted to frame the top and the bottom of the wire panel; and at least two heavy-gauge tubular steel vertical frame members adapted to frame the opposing sides of the wire panel;

wherein the vertical frame members are adapted to vertically extend from the top of the wire panel to a point below the bottom of the wire panel; and wherein the framed wire mesh panels are adapted to be horizontally connected.

9. The enclosure system of claim 8 wherein the heavy-gauge horizontal frame members and the heavy-gauge vertical frame members each have a one-inch square cross-section.

10. The enclosure system of claim 8 wherein the vertical frame members are adapted to uniformly extend about three inches below the bottom of the wire panel and wherein the vertical frame members are adapted to connect to the respective base shoes.

11. The enclosure system of claim 8 wherein at least one wire mesh panel includes a pre-hung door.

12. The enclosure system of claim 11 further comprising:

a framed rectangular wire mesh door member hingedly coupled to a vertical frame member; and a wire mesh transom member positioned above the door member, wherein the door member is adapted to swing outwardly from the panel.

13. The enclosure system of claim 11 wherein the door member further comprises a pad lock system, wherein the pad lock system is adapted to lockingly engage the mesh wall.

14. The enclosure system of claim 11 further comprising:

a horizontal track member;

a framed rectangular wire mesh door member slidingly coupled to the horizontal track member; and a framed rectangular wire mesh member non-slidingly coupled to the horizontal track member, wherein the door member is adapted to slide horizontally in the track member.

15. The enclosure system of claim 1 wherein the periphery independently defines a closed geometric area.

16. The enclosure system of claim 1 wherein the mesh wall is coupled to at least one pre-existing vertical wall.

17. The enclosure of claim 1 further comprising a plurality of continuously coupled framed mesh ceiling panels defining a mesh ceiling and wherein the mesh ceiling is coupled to the mesh wall.

18. A security partition comprising:

a wire mesh wall having a plurality of adjacently connected unstacked framed wire mesh panels and defining an enclosure;

a plurality of base shoes anchored to a floor and positioned directly beneath the wire mesh wall, whereby the base shoes support the wire mesh wall above the floor; and a plurality of post members positioned interior of the enclosure, wherein each respective post member is coupled to both the floor and the wire mesh wall; and a plurality of anchor shoes anchored to the floor on a line forming an outline parallel and interior to the enclosure, the distance between two anchor shoes being variable and substantially greater than the width of the framed wire mesh panels;

wherein the framed wire mesh panels are rectangular, each having two long sides and two short sides; and wherein the long sides are oriented vertically.

19. The security partition of claim 18 wherein the plurality of post members is coupled to the floor through a plurality of anchor shoes.

20. A method for assembling a security partition, comprising the steps of:

a) defining a periphery of an area to be enclosed;

b) spacing base shoes along the periphery;

c) inserting the bottom portions of rectangular mesh panels with the base shoes;

d) rotating the mesh panels into a vertical orientation;

e) attaching adjacent mesh panels together to form a substantially continuous wall;

f) fastening anchor shoes to a floor offset from and adjacently interior to the wall;

g) inserting the posts vertically into a respective anchor shoe; and h) securing the posts to the respective anchor shoes and to the wall.

21. The method of claim 20 further including the steps of:

before defining a periphery, providing at least one framed rectangular panel;

providing a plurality of base shoes;

providing a plurality of anchor shoes; and providing a plurality of posts.

22. The method of claim 21 further comprising the step of:

spacing base shoes at intervals correlating to the widths of the mesh panel members; and after spacing base shoes along the periphery and aligning panels into the base shoes, fastening the base shoes to a floor.

* * * * *